US006726981B1

(12) United States Patent
Steinbeck et al.

(10) Patent No.: US 6,726,981 B1
(45) Date of Patent: Apr. 27, 2004

(54) RECORDING MATERIAL FOR THE INK-JET RECORDING PROCESS

(75) Inventors: Reiner Steinbeck, Osnabrück (DE); Detlef Wacker, Osnabrück (DE); Volker Brauer, Osnabrück (DE); Kirsten Werner, Maidenhead (GB); Richard Barcock, Aylesbury (GB)

(73) Assignee: Felix Schoeller Jr. Foto-und Spezialpapiere GmbH & Co. KG (DE)

( * ) Notice: Subject to any disclaimer, the term of this patent is extended or adjusted under 35 U.S.C. 154(b) by 158 days.

(21) Appl. No.: 09/599,402

(22) Filed: Jun. 22, 2000

(30) Foreign Application Priority Data

Jun. 29, 1999 (DE) ..... 199 29 858

(51) Int. Cl.[7] ..... B41M 5/00
(52) U.S. Cl. ..... 428/195; 428/474.4; 428/500
(58) Field of Search ..... 428/195, 474.4, 428/500

(56) References Cited

U.S. PATENT DOCUMENTS 4,854,995 A * 8/1989 Kasper et al. ..... 156/243
5,139,868 A * 8/1992 Mori et al. ..... 428/327
5,853,859 A 12/1998 Levy et al. ..... 428/196
5,942,329 A * 8/1999 Nakayama et al. ..... 428/423.1
6,284,839 B1 * 9/2001 Fahey et al. ..... 525/66

FOREIGN PATENT DOCUMENTS

| | | |
|---|---|---|
| DE | 23 56 720 | 5/1975 |
| EP | 726 162 | 8/1996 |
| EP | 737 592 | 10/1996 |
| FR | 2 660 251 A1 | 10/1991 |
| JP | 04 065238 | 3/1992 |
| WO | WO 98/52765 | 11/1998 |

OTHER PUBLICATIONS

Search Report in European Application No. EP 00 11 3345, mailed Aug. 19, 2002.

* cited by examiner

*Primary Examiner*—Bruce H. Hess
(74) *Attorney, Agent, or Firm*—Cook, Alex, McFarron, Manzo, Cummings & Mehler, Ltd.

(57) ABSTRACT

A recording material for the ink-jet printing method, comprising a support material and at least one polymer layer arranged on the support, and the polymer layer is an extruded layer and comprises a polyether group-containing thermoplastic copolymer.

6 Claims, No Drawings

RECORDING MATERIAL FOR THE INK-JET RECORDING PROCESS

FIELD OF THE INVENTION

The invention relates to a recording material for the ink-jet recording process.

BACKGROUND OF THE INVENTION

The technology for producing color printouts connected with the general spreading of electronic media has gained great importance in recent years. The goal of this technology is the adaptation of the image quality of color printouts to the level of silver salt-based photography.

An important technology is the ink-jet recording process which in recent years has provided an increasingly improved image quality. In the ink-jet method individual ink droplets are brought onto a recording material with the aid of different techniques that have been described repeatedly. High expectations are placed on the recording materials used in these technologies. These include, for example, high-resolution and high color density of the produced image, no color bleeding, short drying times of the ink, light stability as well as dimensional stability. A further important requirement for commercial applications is the surface gloss. This is especially important in the context of producing art prints, but also for producing images requiring a photo-like impression.

From EP 0 650 850 A2 a recording material is known which is comprised of a polyolefin-coated base paper and a receiving layer. The material allows the production of images with high resolution, color density, and high gloss which in their overall impression are comparable to conventional photographic images. A disadvantage of these receiving materials is their bad drying properties.

In JP 10-119424 a recording material having high gloss is suggested which comprises a hydrophobic carrier and two porous silicic acid-containing layers wherein the silicic acid of the upper layer has smaller particles than the silicic acid of the lower layer. A disadvantage of this recording material is the long drying time.

In a few other publications glossy recording materials are claimed in which the receiving layer is pressed in a cast coating process against a heated dead-smooth cylinder surface so that the recording material is provided with a high gloss surface.

SUMMARY OF THE INVENTION

It is an object of the present invention to provide a high gloss recording material for ink-jet recording processes with which images of high color density and minimal mottle can be produced and which has a good wiping fastness.

This object is solved with a recording material that comprises a support material and at least one polymer layer. The polymer layer can be arranged directly on the support and can be applied by extrusion. The polymer layer comprises a polyether group-containing thermoplastic copolymer.

The inventive recording materials are characterized by high gloss, which can be increased even more by treatment with a calender or with a cooling roller. They exhibit high wiping fastness while providing excellent color density and excellent mottle values. The recording material according to the invention has an improved ink absorbing capability in comparison to the polyolefin layers of known ink-jet recording materials.

The polymer layer can also be a mixture of the polyether group-containing copolymer and other polymers. The proportion of the other polymers in the mixture with the copolymers to be employed according to the invention can be approximately 1 to 50 wt. %, preferably up to 40 wt. %, based on the mass of the mixture.

DETAILED DESCRIPTION OF THE PREFERRED EMBODIMENT

In a special embodiment of the invention, the polymer layer comprises a polyether amide block copolymer, wherein a block polymer with a number of polyether groups of 2 to 20 in each of the repeating copolymer segments provides especially good results.

Polyether amide block copolymers suitable according to the invention are, for example, those of the general formula

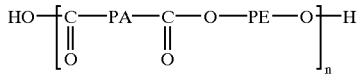

wherein PA is a polyamide segment and PE is a polyether segment. The individual segments can be connected to one another by carboxyl groups. A polyether segment can have 2 to 30, preferably 5 to 20 functional ether groups.

In a further preferred embodiment of the invention, the polyether group-containing copolymer is a polyether ester copolymer.

Suitable as further polymers in a mixture with the copolymer to be used according to the invention are thermoplastic polymers such as polyolefins, ethylene copolymers, polyesters, polycarbonates, polyurethanes, and/or extruded polyvinyl alcohol homopolymers or polyvinyl alcohol copolymers.

Further additives, such as white pigments, color pigments, fillers, especially absorptive fillers and pigments such as aluminum oxide, aluminum hydroxide and/or silicic acid, as well as color fixation agents, dispersing agents, softeners and optical brighteners can be contained in the polymer layer. Titanium dioxide can be used as a white pigment. Further fillers and pigments are calcium carbonate, magnesium carbonate, clay, zinc oxide, aluminum silicate, magnesium silicate, ultramarine, cobalt blue, and carbon black or mixtures of these materials. The fillers and/or pigments are used in quantities of 1 to 40 wt. %, especially 5 to 20 wt. %. The quantities given are based on the mass of the polymer layer.

The applied weight of the extruded polymer layer can be 5 to 50 g/m$^2$, preferably 10 to 30 g/m$^2$. The polymer layer can be applied onto the front side of the support material in the form of a single layer according to an extrusion method known to a person skilled in the art or in the form of multiple layers by means of a co-extrusion method. However, it can also be applied to the backside of the support material.

Preferably, a zone temperature of 160 to 340° C., especially 180 to 320° C., is adjusted within the extruder. It was found to be especially advantageous, in particular, when using one inch extruders, to mix the employed resins and further additives at a rotational speed of the worm gear of 70 to 150 rpm and to extrude the resulting mixtures. When other extruders are used, the rotational speed of the worm gear should be preferably adjusted such that the viscosity of the mass to be extruded corresponds to that in a one inch worm gear extruder at a rotational speed of more than 70 rpm and a temperature of 160 to 320° C.

In order to achieve gloss values as high as possible, it is advantageous to use a high gloss cooling roller in the extrusion process.

In principal, any raw paper can be used as support material. Preferably, surface sized, calendered or non-calendered or heavily sized raw paper products are used. The paper can be sized to be acidic or neutral. The raw paper should have a high dimensional stability and should be able to absorb the liquid contained in the ink without curl formation. Paper products with high dimensional stability of cellulose mixtures of coniferous cellulose and eucalyptus cellulose are especially suitable. Reference is made in this context to the disclosure of DE 196 02 793 B1 which describes a raw paper as an ink-jet recording material. The raw paper can have further additives conventionally used in the paper industry and additives such as dyes, optical brighteners or defoaming agents. Also, the use of waste cellulose and recycled paper is possible. However, it is also possible to use paper coated on one side or both sides with polyolefins, especially with polyethylene, as a support material.

In a further embodiment of the invention the recording material can have an additional layer. This additional layer can have the function of an ink absorbing layer. This layer can be applied as an aqueous dispersion or solution. The additional layer can be applied in the form of a single layer or multiple layers. It can contain hydrophilic or water-soluble binders, dye-fixation agents, dyes, optical brighteners, curing agents as well as inorganic and/or organic pigments.

Polymers can be used as binders such as, for example, polyvinyl alcohol and its modifications, starch and starch derivatives, gelatin, casein, cellulose derivatives, styrene/butadiene latex, vinyl copolymers, polyvinyl pyrrolidone and acrylic esters.

In order not to impair the gloss of the recording material, the pigment used within the ink absorbing layer may be a finely divided inorganic pigment with a particle size of 0.01 to 1.0 $\mu$m, especially 0.02 to 0.5 $\mu$m. Especially preferred, however, is a particle size of 0.1 to 0.3 $\mu$m. The pigment can be selected from the group of oxides, carbonates, silicates or sulfates of alkali metals, earth alkali metals such as silicic acid, aluminum oxide, barium sulfate, calcium carbonate and magnesium silicate. Especially well suited are silicic acid and aluminum oxide with an average particle size of less than 0.3 $\mu$m. However, a mixture of silicic acid and aluminum oxide with an average particle size of less than 0.3 $\mu$m can also be employed.

The quantity ratio of pigment to binder can be 20:1 to 1:5. The applied weight of the layer can be 0.5 to 40 g/m$^2$, preferably 1 to 30 g/m$^2$.

For the application of the ink absorbing layer(s) any desired, generally known application and dosage method can be used, such as roller application, gravure coating, nip method and air brush or roll coater dosage methods. Especially preferred is the application by means of a cascade coating device or a slot casting device.

For adjusting the curl behavior, anti-static behavior, and the transportability in the printer, the backside can be provided with a separate functional layer. Suitable backside layers are described in DE 43 08 274 A1 and DE 44 28 941 A1, and reference is being had to their disclosure.

The following examples are provided to further explain the invention.

EXAMPLES

Raw paper A

With a Fourdrinier paper machine a paper with a gsm weight of 83 g/m$^2$ and a thickness of 87 $\mu$m was produced (raw paper A). The cellulose had a freeness value of 29 according to Schopper/Riegler. The cellulose employed was comprised of approximately 42 wt. % pine sulfate cellulose and approximately 54 wt. % eucalyptus cellulose. Moreover, 4 wt. % clay was added as a pigment. As a sizing agent 0.1 wt. % alkylketene dimer, 0.05 wt. % starch, and as a wet strengthening agent 0.5 wt. % polyamide/polyamine epichlorohydrin resin were added. For surface sizing a 7.0 wt. % polyvinyl alcohol solution was employed. The paper had a roughness according to Sheffield of 98.

Raw paper B

With a Yankee paper machine a paper of a gsm weight of 130 g/m$^2$ and a thickness of 138 $\mu$m was produced. The cellulose had a freeness value of 27 according to Schopper/Riegler. The cellulose employed was comprised of approximately 24.5 wt. % pine sulfate cellulose and approximately 67 wt. % eucalyptus cellulose. Clay in an amount of 8.5 wt. % was added as a pigment. As a sizing agent 0.55 wt. % alkylketene dimer and as a wet strengthening agent 0.6 wt. % polyamide/polyamine epichlorohydrin resin were added. For surface sizing a 1.97 wt. % starch solution was employed. The paper had a roughness according to Sheffield of 120.

The provided weight data of cellulose and pigments refer to the addition of these materials to the pulp, the provided weight data of the sizing agents and wet strengthening agents refer to the dry fiber contents.

Example 1

The front side of raw paper A was coated with a polyether amide block polymer, PEBAX® MV 6100 SL 01, by means of a 1"-extruder. In this context, a temperature profile in the extruder of 190 to 280° C. was adjusted. For improving adhesion of the layer, the rotational speed of the worm gear was adjusted above 70 revolutions per minute (rpm). Subsequently, the obtained laminate was guided across a high-gloss cooling cylinder. The applied weight of the extruded polymer layer was 20 g/m$^2$.

The backside of the raw paper A was coated with clear polyethylene which was a mixture of LDPE and HDPE (35% HDPE of a density d=0.963 g/cm$^3$, MFI=8; 65% LDPE with d=0.923 g/cm$^3$, MFI=4.4).

Example 2

The raw paper A was coated under the same conditions as in Example 1 with a mixture of 98 wt. % polyether amide block polymer, PEBAX® MV 6100 SL 01, and 2 wt. % of a 50% $TiO_2$ master batch (50 wt. % anatase $TiO_2$, 1.5 wt. % Zn stearate, 48.5% LDPE) by extrusion. The applied weight was 23 g/m$^2$. The backside was coated with a clear polyethylene as in Example 1.

Example 3

The raw paper A was coated under the same conditions as in Example 1 with a mixture of 90 wt. % polyether amide block polymer, PEBAX® MV 6100 SL 01, and 10 wt. % of a 50% $TiO_2$ master batch (as in Example 2) by extrusion. The applied weight was 23 g/m$^2$. The backside was coated with a clear polyethylene as in Example 1.

Example 4

The front side of the raw paper B was coated under the same conditions as in Example 1 with a polyether amide block polymer, PEBAX® MV 3000, by extrusion. The applied weight was 20 g/m$^2$. The backside was coated with a clear polyethylene as in Example 1.

Example 5

The raw paper B was coated under the same conditions as in Example 1 with a mixture of 98 wt. % polyether amide block polymer, PEBAX® MV 3000, and 2 wt. % of a 50% $TiO_2$ master batch (as in Example 2) by extrusion. The applied weight was 23 g/m$^2$. The backside was coated with a clear polyethylene as in Example 1.

Example 6

The raw paper B was coated under the same conditions as in Example 1 with a mixture of 90 wt. % polyether amide block polymer, PEBAX® MV 3000, and 10 wt. % of a 50% $TiO_2$ master batch (as in Example 2) by extrusion. The applied weight was 23 g/m$^2$. The backside was coated with a clear polyethylene as in Example 1.

Example 7

On the front side of the coated paper according to Example 1 an ink absorbing layer of an aqueous dispersion was applied. The composition of the ink absorbing layer is as follows:

| | |
|---|---|
| polyvinyl alcohol<br>degree of saponification: 98%<br>viscosity: 62.72 cP (4% aq. solution, at 20° C.) | 6.5 wt. % |
| aluminum oxide:<br>average particle size: 130 to 140 nm,<br>specific surface area: 50 to 60 m$^2$/g | 93.0 wt. % |
| boric acid | 0.5 wt. % |
| The given weight data refer to the dried layer. | |

Example 8

To the front side of the paper coated according to Example 4 an ink absorbing layer of an aqueous dispersion was applied as in Example 7.

Comparative Example 1

As a comparative example a basic paper coated on both sides with polyethylene was used. For this purpose, the paper A was coated by extrusion on the front side with a low-density polyethylene (LDPE) with a $TiO_2$ content of 10 wt. %, and on the backside with a clear LDPE. The front side application was 19 g/m$^2$ and the backside application was 22 g/m$^2$.

Comparative Example 2

Onto the coated front side of the polyethylene-coated paper produced according to Comparative Example 1 an ink absorbing layer was applied according to Example 7.

Testing of the Recording Paper Products Produced According to the Examples and Comparative Examples The recording paper products were printed by means of an ink-jet printer HP 890 at 1,440 dpi (dots per inch).

The resulting test print images were examined with regard to color density, bleeding, wiping fastness, and mottle.

Gloss

Gloss was determined on unprinted material with the laboratory reflectometer RL3 of the company Dr. Lange according to DIN 67530 at a measuring angle of 60°.

Color Density

The color density was measured with an X-Rite densitometer type 428 with the colors cyan, magenta, yellow and black.

Bleeding

Bleeding of the inks at the edges of adjoining color areas was examined visually and rated from 1 to 5 (very good to very bad).

Wiping Fastness

The wiping fastness was tested by rubbing the printed image with a white rag. This test method was performed for each color individually and rated. The rating 1 stands for a very good wiping fastness (no color traces detectable on the rag) and the rating 5 stands for bad wiping fastness (considerable color traces detectable on the rag).

Mottle

The cloudiness or mottle of a color area was visually examined and rated from 1 through 5 (very good to very bad).

The test results are compiled in Table 1.

TABLE 1

| | Test results | | | | | | | |
|---|---|---|---|---|---|---|---|---|
| | color density | | | | | bleed | wiping | |
| | cyan | magenta | yellow | black | gloss | rating | fastness | mottle |
| 1 | 1.70 | 1.20 | 1.34 | 1.25 | 56.2 | 2 | 2 | 2 |
| 2 | 1.68 | 0.71 | 1.15 | 1.49 | 50.0 | 2 | 2 | 2 |
| 3 | 2.28 | 1.26 | 1.42 | 1.01 | 52.6 | 2 | 2.5 | 2 |
| 4 | 2.25 | 1.35 | 1.46 | 2.45 | 68.0 | 2 | 2 | 2 |
| 5 | 1.80 | 1.35 | 1.16 | 2.50 | 51.3 | 2 | 2 | 2.5 |
| 6 | 1.82 | 1.35 | 1.21 | 2.44 | 49.2 | 2 | 2 | 2 |
| 7 | 2.41 | 1.38 | 1.65 | 2.25 | 36.2 | 2 | 1 | 1 |
| 8 | 2.35 | 1.36 | 1.76 | 2.30 | 36.9 | 2 | 1 | 1.5 |
| V1 | 1.59 | 1.45 | 1.39 | 1.20 | 80.3 | 4 | 5 | 3 |
| V2 | 2.39 | 1.37 | 1.78 | 2.35 | 20.5 | 3 | 2 | 1.5 |

As can be taken from the table, with the aid of the extrudable copolymers according to the invention high gloss ink-jet recording paper products can be produced which provide overall good results also with respect to color density, wiping fastness, bleeding, and mottle.

We claim:

1. A recording material for the ink-jet printing method, comprising a support material, at least one polymer layer arranged on the support material, and wherein said polymer layer is an extruded layer and comprises a polyether group-containing thermoplastic coplymer, and an ink absorbing layer arranged above said polymer layer.

2. A recording material according to claim 1, wherein said copolymer has repeating copolymer segments, and the number of polyether groups in each of said segments is 2 to 20.

3. A recording material according to claim 1, wherein said polymer layer contains a mixture of said polyether group-containing copolymer and a thermoplastic polymer.

4. A recording material according to claim 3, wherein said thermoplastic polymer is selected from the group consisting of polyolefins, ethylene copolymers, polyesters, polycarbonates and polyurethanes.

5. A recording material according to claim 3, wherein the amount of said thermoplastic polymer is 1 to 50 wt. %, based on the polymer mixture.

6. A recording material according to claim 1, wherein the polymer layer comprises approximately 40 wt. % pigment.

* * * * *